United States Patent [19]

Sheehan et al.

[11] Patent Number: 4,620,319

[45] Date of Patent: Oct. 28, 1986

[54] COLLAPSIBLE CONTAINER FRAME

[75] Inventors: Joseph C. M. Sheehan, Burr Ridge; Bruce P. Dorr, Westmont, both of Ill.

[73] Assignee: Kells Medical, Inc., Burr Ridge, Ill.

[21] Appl. No.: 709,544

[22] Filed: Mar. 8, 1985

[51] Int. Cl.[4] ..... B65D 33/00; B65B 67/04

[52] U.S. Cl. ..... 383/33; 211/99; 248/101

[58] Field of Search ..... 211/96, 99, 169.1; 248/95, 99, 101, 100; 150/51; 383/11, 33, 34, 34.1

[56] References Cited

U.S. PATENT DOCUMENTS

| | | | |
|---|---|---|---|
| 179,712 | 7/1876 | Marsh | 248/99 |
| 199,051 | 1/1878 | Frisbie et al. | 248/99 |
| 247,332 | 9/1881 | Gardner | 248/99 |
| 945,645 | 1/1910 | Vonderahe, Jr. | 248/99 |
| 988,097 | 3/1911 | Heyd | 248/101 |
| 2,491,515 | 12/1949 | Orchard | 248/99 |
| 2,744,709 | 5/1956 | Gronek | 248/99 |
| 2,965,344 | 12/1960 | Baker | 248/101 |
| 3,679,160 | 7/1972 | Ballenger | 248/101 X |
| 3,716,938 | 2/1973 | Ammons | 248/99 X |
| 3,779,496 | 12/1973 | Welles | 248/99 |
| 4,223,858 | 9/1980 | de Salazar | 248/101 |

FOREIGN PATENT DOCUMENTS

| | | | |
|---|---|---|---|
| 2431 | of 1888 | United Kingdom | 248/99 |

*Primary Examiner*—William Price
*Assistant Examiner*—Bryon Gehman
*Attorney, Agent, or Firm*—Willian, Brinks, Olds, Hofer, Gilson & Lione, Ltd.

[57] ABSTRACT

A collapsible bag frame includes a one piece part which defines a frame, a mounting member, and two tabs. The mounting member is hinged to the frame, and the tabs are hinged to the frame. A bag such as a garbage bag is secured to the frame by a wire clamp. The tabs are movable from a first position, in which the frame is allowed to rest alongside a wall, and a second position, in which the tabs hold the frame out from the wall, thereby positioning the frame for use.

17 Claims, 11 Drawing Figures

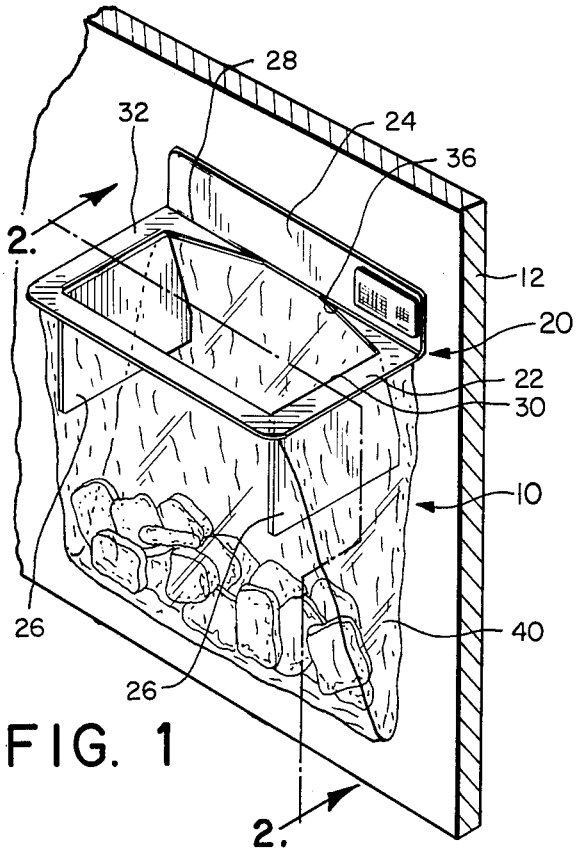
FIG. 1
FIG. 3
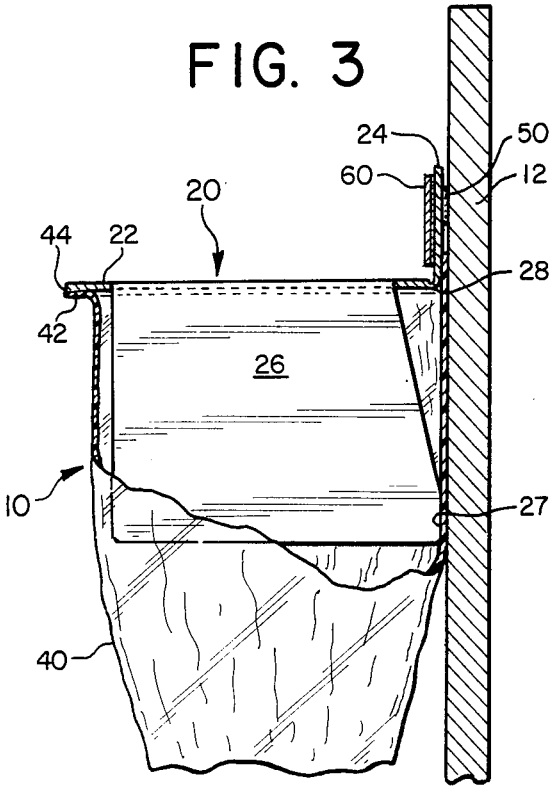
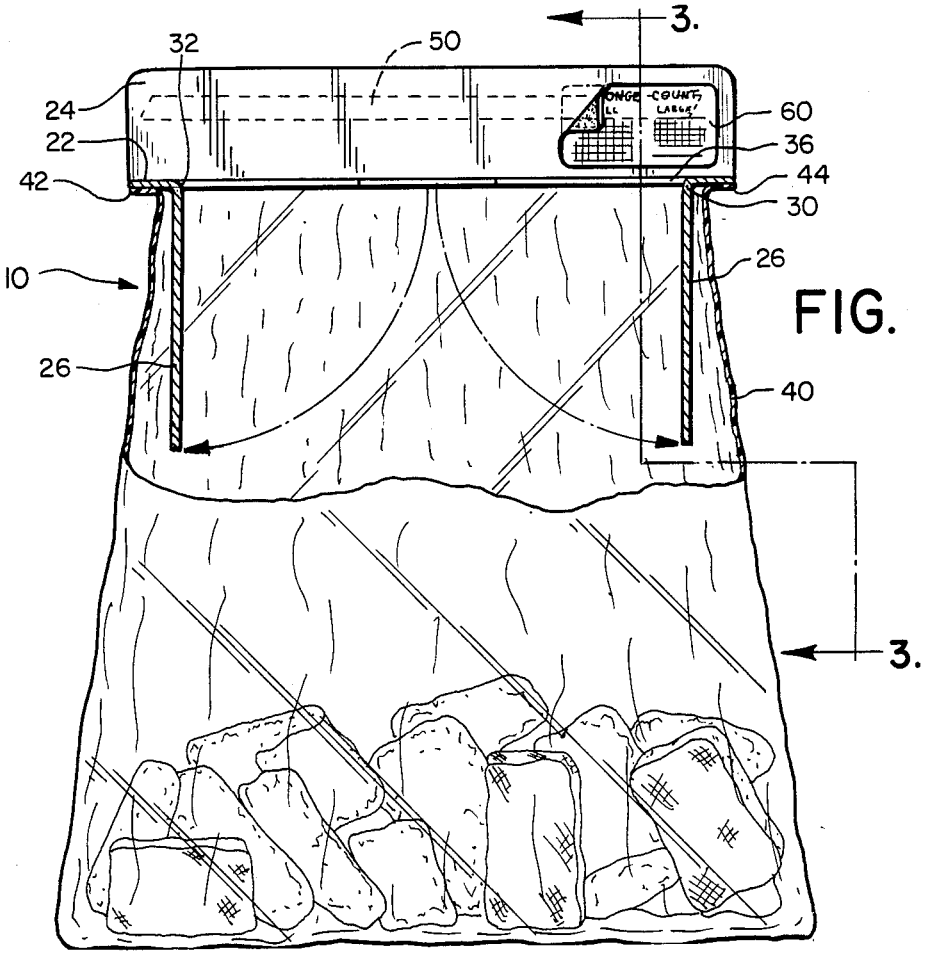
FIG. 2

COLLAPSIBLE CONTAINER FRAME

BACKGROUND OF THE INVENTION

The present invention relates to a collapsible frame of a type that can be used to support a container such as a bag in position for use.

Flexible bags such as garbage bags and the like have come into wide spread use in a variety of applications. However, one drawback to such bags is that if unsupported they typically do not remain open, ready for use. Instead a typical bag will sag, and its mouth will not be oriented to receive articles. For this reason, a need presently exists for an inexpensive, compact bag holder which occupies a minimum of space when not in use, yet which can be used to hold a bag open in a simple and reliable manner.

SUMMARY OF THE INVENTION

The present invention is directed to a collapsible frame for a container such as a bag, which frame includes a frame member which defines a perimeter and a central opening. Means are provided for mounting the frame member to a vertical surface such as a wall such that the frame member is pivotable between a stowed position, alongside the vertical surface, and an operative position, extending outwardly from the vertical surface. Means are provided for securing a flexible container to the frame member such that the central opening provides access into the container. At least one tab is hingedly mounted to move between a first position, in which the tab extends alongside the frame member, and a second position, in which the tab reacts against the vertical surface to hold the frame member in the operative position.

Alternative embodiments of this invention can be designed for use either with bags that are permanently affixed to the frame member, or with bags that are removable from the frame member in order to allow a single frame member to be used with multiple bags. Because the frame member can be pivoted to the stowed position alongside the vertical surface, the collapsible frame of this invention occupies a minimum of space when not in use.

The invention itself, together with further objects and attendant advantages, will best be understood by reference to the following detailed description, taken in conjunction with the accompanying drawings.

BRIEF DESCRIPTION OF THE DRAWINGS

FIG. 1 is a perspective view of a first preferred embodiment of this invention.

FIG. 2 is a partial sectional view taken along line 2—2 of FIG. 1.

FIG. 3 is a partial sectional view taken alone line 3—3 of FIG. 2.

Figure 7A:
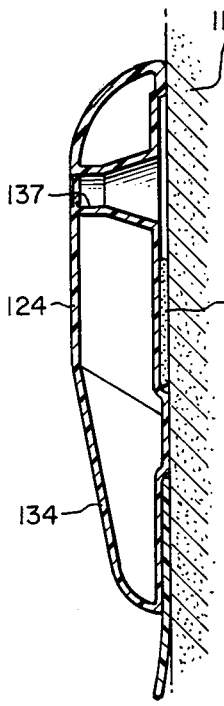
FIG. 7 is a plan view of the embodiment of FIG. 5 in the stowed position.
Figure 7B:
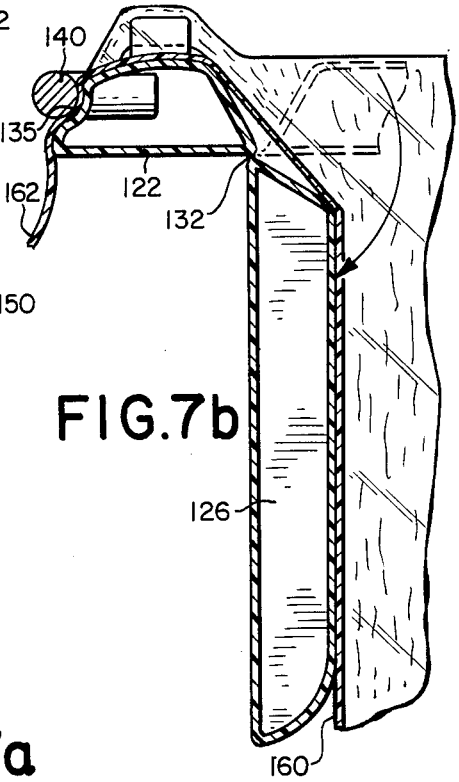
Figure 7C:
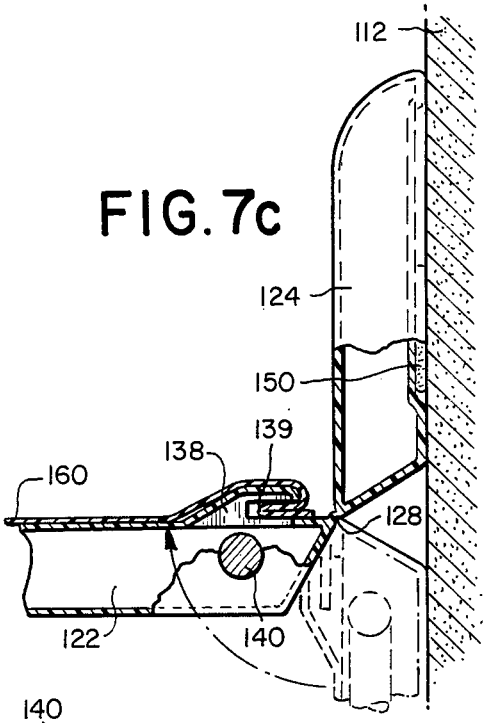
Figure 7D:
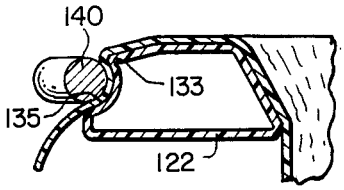
Figure 7:
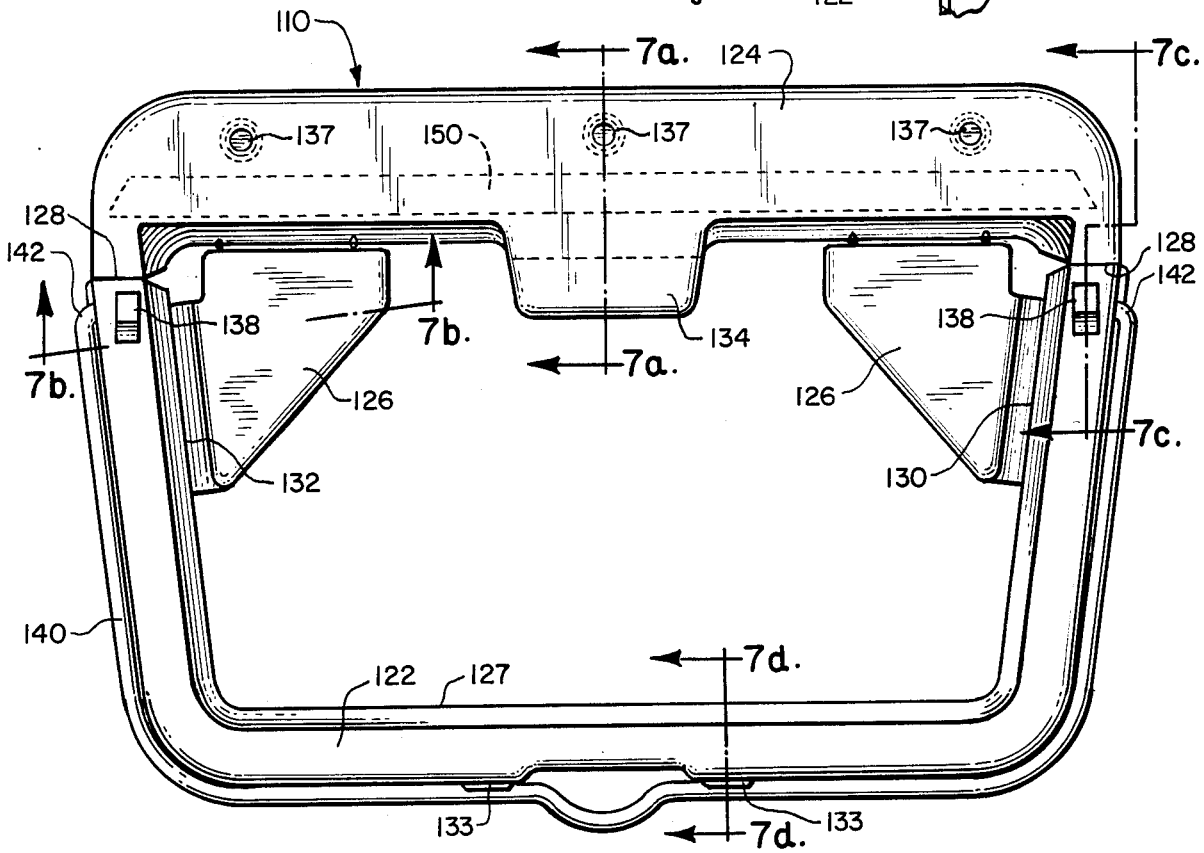

FIG. *7a* is a sectional view taken along line *7a*—*7a* of FIG. 7.

FIG. *7b* is a sectional view taken along line *7b*—*7b* of FIG. 7, showing one of the tabs in the operative position.

FIG. *7c* is a sectional view taken along line *7c*—*7c* of FIG. 7, showing the frame in the operative position.

FIG. *7d* is a sectional view taken along line *7d*—*7d* of FIG. 7, showing the frame in the operative position.

DETAILED DESCRIPTION OF THE PRESENTLY PREFERRED EMBODIMENTS

Figure 4:
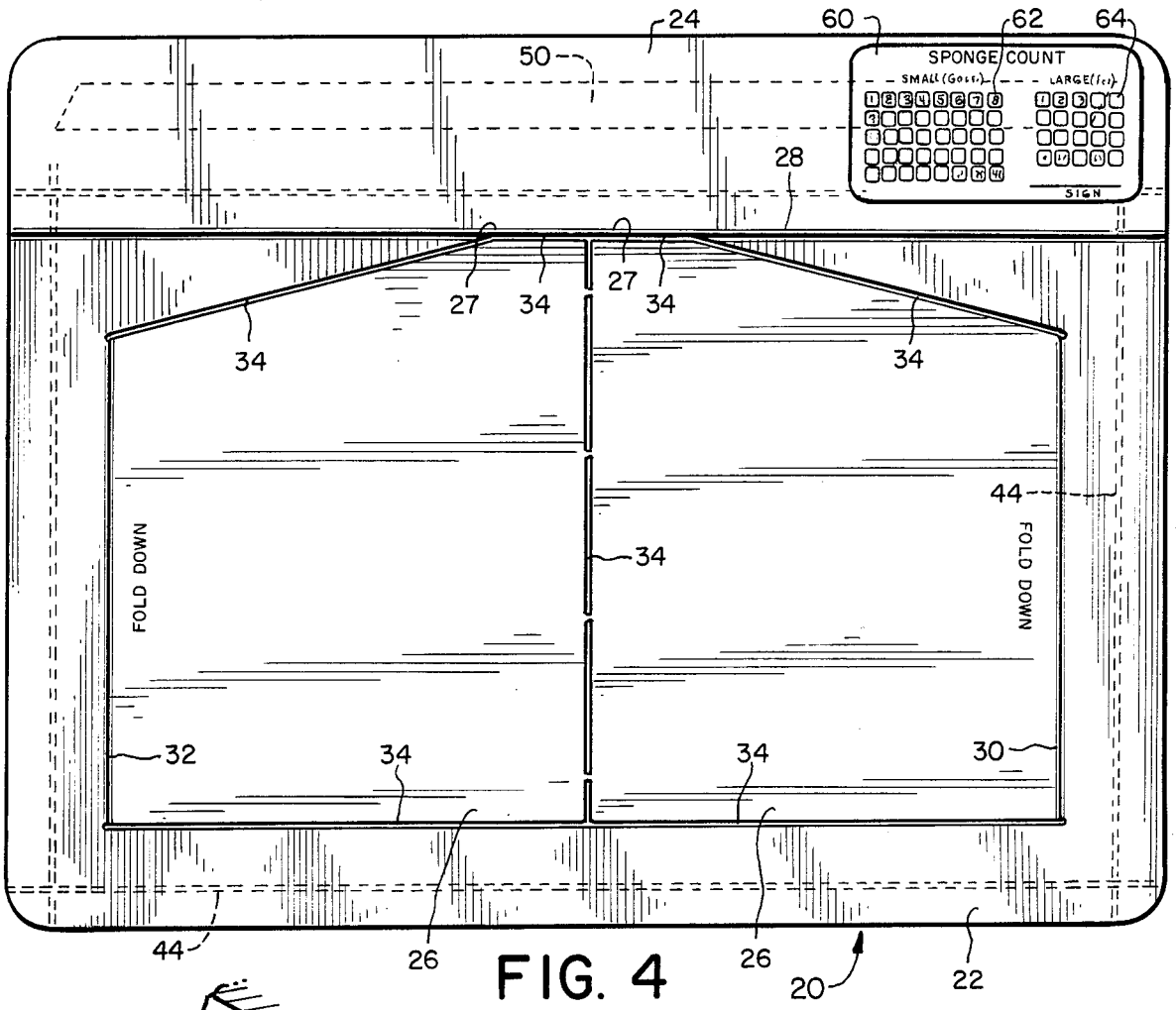
FIG. 4 is a plan view of the unfolded sheet which forms the principle structural component of the embodiment of FIG. 1.
Figure 5:
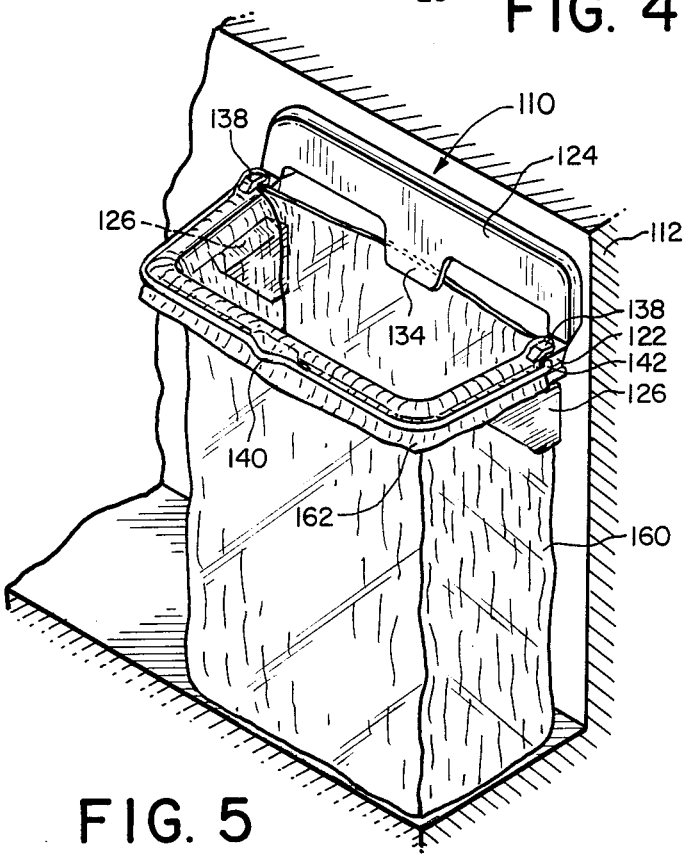
FIG. 5 is a perspective view of a second preferred embodiment of this invention in the operative position.

Turning now to the drawings, FIGS. 1–4 relate to a first preferred embodiment of this invention and FIGS. 5–*7d* relate to a second preferred embodiment of this invention.

The First Preferred Embodiment

As shown in FIG. 1, the first preferred embodiment 10 is adapted to be mounted to a vertical surface such as a wall 12. This embodiment 10 includes two major components: a sheet 20 of a material such as paperboard or chipboard and a plastic bag 40.

FIG. 4 shows a plan view of the sheet 20 which includes the principle structural components of the embodiment 10. In this embodiment, the sheet 20 is die cut from a single piece of chipboard. The sheet 20 defines a frame panel 22, a mounting panel 24, and two tabs 26. The mounting panel 24 is connected to the frame panel 22 at a fold line 28, and the tabs 26 are connected to the frame panel 22 by respective fold lines 30, 32. In FIG. 4 the reference numeral 34 is used to designate a series of die cut lines which, in cooperation with the fold lines 30, 32, define the perimeter of the tabs 26. The frame panel 22 defines a central opening 36 when the tabs 26 are folded down as shown in FIGS. 1–3.

In this embodiment the bag 40 defines an open end 42 which is secured to the underside of the frame panel 22 and the mounting panel 24 around the opening 36. In FIG. 4 the reference symbol 44 is used to designate a typical location for adhesive bonds such as heat seals which can be used to secure the bag 40 to the sheet 20.

A strip of double sided adhesive tape 50 is secured to the rear side of the mounting panel 24. This adhesive tape 50 is used to secure the mounting panel 24 to the wall 12, as shown in FIGS. 1 and 3.

The preferred embodiment 10 is intended for use as a receptable for sponges in an operating room, and it includes an adhesive sticker 60 used to record a sponge count. This adhesive sticker 60 includes an array of count boxes 62 for small sponges, and a separate array of count boxes 64 for large sponges. The sticker 60 is adhesively held in place to the mounting panel 24 such that it can be removed after use and re-affixed to a patient file.

Solely by way of example, in this preferred embodiment the sheet 20 is formed from a clay coated, white backed 24 point chip board, and is coated on the underside with a thermoplastic varnish such as that marketed under the tradename Surlyn. In this embodiment, the bag 40 is formed of one mil polyethylene, and standard bar-type heat sealing techniques are used to activate the varnish in order to bond the open end 42 of the bag 40 to the underside of the frame panel 22 in the mounting panel 24.

The embodiment 10 of FIGS. 1–4 can be packed for sale in a folded flat form, substantially as shown in FIG. 4. At the time of use, the tabs 26 are folded down, into the bag 40, as shown in FIGS. 1 through 3. In addition, the mounting panel 24 is folded at right angles with respect to the frame panel 22. Then a release paper covering the adhesive tape 50 is removed, and the adhesive tape 50 is used to affix the mounting panel 24 to the wall 12. The tabs 26 are then adjusted, such that the lower edges 27 of the tabs 26 bear against the wall 12. In this position the tabs 26 both hold the frame panel 22 in the operative position shown in FIGS. 1–3 and hold the bag 40 open. It has been found that relatively long tabs 26 as shown in FIGS. 1–4 reduce the tendency of the mounting panel 24 to peel away from the wall 12. In addition, relatively long tabs 26 as shown in FIGS. 1–4 provide the advantage that they can be used to close the central opening 36 if desired. If, for example, the bag 40 is only partly filled as shown in FIG. 1 and the tabs 26 are returned to the position shown in FIG. 4, the tabs 26 close the central opening 36, and they allow the frame panel 22 to pivot downwardly toward the wall 12. In this way, the bag 40 and the sheet 22 are both caused to lie against the wall 12, thereby occupying a minimum of space.

The sponge count sticker 60 can be used to record the number of sponges placed into the bag 40. When a surgical procedure is finished, the sponge count sticker 60 can then be signed, peeled away from the mounting panel 24, and re-affixed to a patient file. In this way, the maintenance of proper sponge count records is facilitated.

Because the bag 40 is heat sealed to the sheet 20, the embodiment 10 of FIGS. 1–4 is a disposable unit, intended only for a single use. After use, the mounting panel 24 can be stripped away from the vertical surface 12, and the entire unit discarded.

The embodiment 10 of FIGS. 1–4 provides important advantages in that it folds flat for storage and shipment, and that it holds the bag 40 open for use in a simple and reliable manner. Because it is formed of relatively inexpensive materials, the embodiment 10 can be manufactured at relatively low cost, and is extremely well suited for use in a hospital environment.

The Second Preferred Embodiment

Turning now to drawings 5–7*d*, a second preferred embodiment 110 of this invention is also adapted for mounting to a vertical surface such as a wall 112. The embodiment 110 is designed for reuse, and therefore utilizes different materials and construction techniques than the first preferred embodiment described above.

As shown in FIGS. 5–7*d*, the second embodiment 110 includes a frame 122, a mounting panel 124, and a pair of tabs 126. In this embodiment, each of these elements is formed in one piece in an injection molding or blow molding operation out of a material such as polypropylene. Polypropylene provides the important advantage that it can be used to form one piece, integrated, living hinges. In this embodiment, the mounting panel 124 is pivotably connected to the frame 122 by living hinges 128, and each of the tabs 126 is pivotably connected to the frame 122 by a respective living hinge 130, 132. The frame 122 defines a central opening 127, and the mounting panel 124 defines a plurality of screw holes 137. A pair of raised lugs 138 are mounted on the upper side of the frame 122 near the living hinges 128, and each of these lugs 138 defines a respective slot 139 facing the mounting panel 124. A quarter round groove 135 is defined by the outside of the frame 122, and a pair of snap ridges 133 are defined on a portion of the frame 122 opposite the mounting panel 124. The mounting panel 124 defines a rigid tongue 134 positioned to extend into the central opening 126 when the mounting panel 124 is in the stowed position shown in FIG. 7.

The embodiment 110 includes a wire clamp 140 which defines two ends 142 and is shaped to fit within the groove 135. The ends 142 of the clamp 140 are pivotably mounted in respective holes defined by the frame 122. A strip of double sided adhesive tape 150 is secured to the back side of the mounting panel 124.

By way of example, this second preferred embodiment 110 can be blow molded from polypropylene. In this embodiment, the clamp 140 is preferably formed of ¼ inch diameter stainless steel wire, and the adhesive 150 can for example be a 3/32 inch foam tape coated with adhesive on both sides, of the type distributed by 3M.

Figure 6:
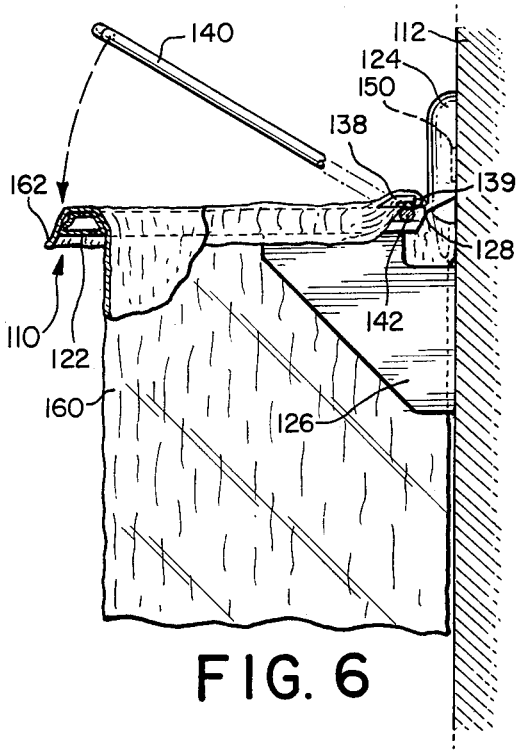
FIG. 6 is a side view of the embodiment of FIG. 5 in the operative position.

In use, a release paper covering the adhesive 150 is removed and the mounting panel 124 is adhesively affixed to the wall 112. If desired, screws can be placed in the holes 137 in order to form a stronger bond. Then the tabs 126 are folded downwardly to the position shown in FIG. 7*b*, such that the tabs 126 hold the frame 122 away from the wall 112, as shown in FIGS. 5 and 6. The clamp 140 is then raised and a bag 160 which defines an open end 162 is inserted into the opening 126 from below. The open end 162 is draped over the sides and front of the frame 122, and is tucked under the tongue 134. The open end 162 is engaged in the slots 139, in order to reduce the tendency of the bag 160 to slip out of the frame 122.

Then the clamp 140 is pivoted downwardly in order to lock the open end 162 of the bag 160 onto the frame 122. The ridges 133 serve to hold the clamp 140 in position. In this way, the bag is supported in an open, easy to fill position. Preferably, the bag should rest on a floor surface when the embodiment 110 is properly positioned. In this way, weight is distributed to the floor rather than hanging from the frame 122. Only outwardly directed forces are applied to the frame 122, which can readily be resisted by the frame 122 and the clamp 140. In the event a standard 30 gallon garbage bag is used, a mounting height of 26 inches has been found to be suitable.

After the bag 160 has been filled, the clamp 140 may be moved to release the bag 160 for removal. After the bag 160 has been removed, the tabs 126 can be returned to the plane of the frame 122, and the entire frame 122 can then be folded down flush with the wall 112. In this way, storage space of the embodiment 110 is kept to a minimum. When the frame 122 is folded against the wall 112, it is remarkably unobtrusive.

Conclusion

Of course, it should be understood that a wide range of changes and modifications can be made to the preferred embodiments described above. Materials can be modified as desired, and other types of plastics, metals or even wood can be used if desired. A wide range of adhesives are suitable, and a wide variety of means can be used for securing the bag to the frame. In addition to the heat bonding and wire clamp illustrated, various types of clamping hoods, clamping clips, and clamping wires can also be used. Of coure, the size and shape of the frame and the mounting panel can be adapted as desired for the particular container to be supported in the intended application. This invention can readily be adapted for a wide variety of uses in hospitals, offices, homes, and garages. It is therefore intended that the foregoing description be regarded as illustrative rather than limiting, and that it be understood that it is the following claims, including all equivalents, which are intended to describe the scope of this invention.

We claim:

1. A collapsible frame for a container, said frame comprising:

a frame member which defines a perimeter and a central opening;

means for mounting the frame member to a vertical surface such that the frame member is pivotable between a stowed position, alongside the vertical surface, and an operative position, extending outwardly from the vertical surface;

means for securing a flexible container to the frame member such that the central opening provides access into the container; and at least one tab hingedly mounted to the frame member to move between a first position, in which the tab extends alongside the frame member to allow the frame member to pivot to the stowed position, and a second position, in which the tab reacts against the vertical surface to hold the frame member in the operative position.

2. The invention of claim 1 wherein said at least one tab comprises two tabs, each positioned to support a respective portion of the frame member in the operative position.

3. The invention of claim 1 wherein the tab is integrally formed with the frame member.

4. The invention of claim 1 wherein the mounting means comprises a mounting panel hingedly mounted to the frame member.

5. The invention of claim 1 wherein the securing means permanently secures the container to the frame member.

6. The invention of claim 1 wherein the securing means releasably secures the container to the frame member.

7. The invention of claim 6 wherein the frame member comprises a clamping member shaped to clamp the container to the frame member.

8. The invention of claim 1 wherein the tab extends into the container when in the second position to hold the container open under the central opening.

9. A collapsible container frame comprising:

a frame element which defines a central opening having four sides;

a mounting element hinged to the frame element along an axis parallel to a first one of the four sides;

two tab elements hinged to the frame element along axes parallel to a second and a third one of the sides, said first side disposed between the second and third sides;

a clamp mounted to the frame element to releasably retain a bag to the frame member with the central opening providing access to the bag; and means for mounting the mounting element to a vertical surface;

said frame element movable between a stowed position, in which the frame element is positioned beneath the mounting element alongside the vertical surface, and an operative position, in which the frame element extends away from the vertical surface;

said tab elements movable between a first position at least partially covering the central opening in which the tab elements allow the frame element to move to the stowed position, and a second position in contact with the vertical surface in which the tab elements are positioned out of the central opening to extend away from the frame element to support the frame element in the operative position.

10. The invention of claim 9 wherein the frame element, mounting element and tab elements are integrally formed of one piece.

11. The invention of claim 9 wherein the mounting element defines a holding element positioned to extend partially into the bag to hold the bag in position on the frame element.

12. The invention of claim 9 wherein the frame element defines two lugs, each facing the mounting element near a respective one of the tab elements, for securing the bag to the frame element.

13. The invention of claim 9 wherein the frame element defines a plane, and wherein the tab elements are positioned in the plane of the frame element when in the first position such that both the frame element and the tab elements are positioned closely alongside the vertical surface when the frame element is in the stowed position.

14. A collapsible container comprising:

a thin sheet of material comprising a frame portion, a mounting portion, and two tab portions, said mounting portion hinged to the frame portion at a first fold line and said tab portions hinged to the frame portion at third and fourth fold lines, respectively, said frame portion defining an opening, said second and third fold lines extending generally transverse to the first fold line, said tab portions at least partially blocking the opening when in a first position;

a flexible bag bonded to the frame portion such that the opening provides access to the bag; and an adhesive secured to the mounting portion;

said adhesive adapted to mount the mounting portion to a vertical surface, said tab portions shaped to fold down, into the bag, to bear against the vertical surface, thereby simultaneously holding the frame portion away from the vertical surface and holding the bag open.

15. The invention of claim 14 wherein the material comprises a chipboard.

16. The invention of claim 14 wherein the bag is heat sealed to the frame portion.

17. The invention of claim 14 further comprising:

a sponge count label; and an adhesive layer on the sponge count label which holds the sponge count label on the sheet such that the sponge count label can be removed from the sheet and re-affixed after use.

* * * * *